US009920502B2

(12) United States Patent
Kawasaki et al.

(10) Patent No.: US 9,920,502 B2
(45) Date of Patent: Mar. 20, 2018

(54) CONTROL SYSTEM FOR HYBRID CONSTRUCTION MACHINE

(71) Applicant: KYB Corporation, Tokyo (JP)

(72) Inventors: Haruhiko Kawasaki, Kanagawa (JP); Masahiro Egawa, Saitama (JP)

(73) Assignee: KYB Corporation, Tokyo (JP)

( * ) Notice: Subject to any disclaimer, the term of this patent is extended or adjusted under 35 U.S.C. 154(b) by 274 days.

(21) Appl. No.: 14/915,654

(22) PCT Filed: Sep. 11, 2014

(86) PCT No.: PCT/JP2014/074129
§ 371 (c)(1),
(2) Date: Mar. 1, 2016

(87) PCT Pub. No.: WO2015/045891
PCT Pub. Date: Apr. 2, 2015

(65) Prior Publication Data

US 2016/0237648 A1 Aug. 18, 2016

(30) Foreign Application Priority Data

Sep. 27, 2013 (JP) ..... 2013-201408

(51) Int. Cl.
*F15B 21/14* (2006.01)
*E02F 9/12* (2006.01)
(Continued)

(52) U.S. Cl.
CPC ..... *E02F 9/123* (2013.01); *E02F 9/2075* (2013.01); *E02F 9/2217* (2013.01);
(Continued)

(58) Field of Classification Search
CPC ..... F15B 21/14; F15B 2211/7058; F15B 2211/6313; E02F 9/123; E02F 9/2296; E02F 9/2075; E02F 9/2217; E02F 9/2292
See application file for complete search history.

(56) References Cited

U.S. PATENT DOCUMENTS 8,720,196 B2 * 5/2014 Kawasaki ..... E02F 9/2075 60/422
8,726,645 B2 * 5/2014 Shang ..... E02F 9/123 60/414
8,806,860 B2 * 8/2014 Kawasaki ..... E02F 9/2075 251/282

FOREIGN PATENT DOCUMENTS

JP 2009-281525 A 12/2009

* cited by examiner

*Primary Examiner* — Thomas E Lazo
(74) *Attorney, Agent, or Firm* — Rabin & Berdo, P.C.

(57) ABSTRACT

A control system for hybrid construction machine includes a regeneration motor configured to be rotated by working fluid introduced from a turning circuit, a pressure detector configured to detect a turning pressure during a turning operation of the turning motor or a braking pressure during a braking operation of the turning motor, a switching valve for turning regeneration configured to perform turning regeneration by introducing the working fluid from the turning circuit to the regeneration motor when being switched to an open position by a pressure of pilot fluid, an electromagnetic proportional pressure reducing valve configured to be switched to an open position and generate a pilot secondary pressure for switching the switching valve for turning regeneration to the open position when a pressure detected by the pressure detector reaches a first set pressure, and a pilot switching valve configured to allow the passage of the pilot fluid for switching the switching valve for turning regeneration to the open position by being switched
(Continued)

to an open position when the pressure of the turning circuit reaches a second set pressure.

12 Claims, 5 Drawing Sheets

(51) Int. Cl.
*E02F 9/20* (2006.01)
*E02F 9/22* (2006.01)

(52) U.S. Cl.
CPC ..... *E02F 9/2267* (2013.01); *E02F 9/2285* (2013.01); *E02F 9/2296* (2013.01); *F15B 21/14* (2013.01); *E02F 9/2292* (2013.01); *F15B 2211/6313* (2013.01); *F15B 2211/7058* (2013.01)

CONTROL SYSTEM FOR HYBRID CONSTRUCTION MACHINE

TECHNICAL FIELD

The present invention relates to a control system for hybrid construction machine with a regeneration device for regenerating energy utilizing working fluid introduced from an actuator.

BACKGROUND ART

A conventional hybrid construction machine is known to regenerate energy by utilizing hydraulic oil introduced from a turning motor and rotating a hydraulic motor.

It is disclosed in JP2009-281525A that an electromagnetic switching valve is switched to an open position for turning regeneration and an opening of a proportional electromagnetic throttle valve provided in parallel to a safety valve is controlled to reduce passage resistance caused by the safety valve when a pressure signal of a pressure sensor for detecting a turning pressure at the time of rotating a turning motor or a braking pressure at the time of braking reaches a pressure set in advance.

SUMMARY OF INVENTION

However, in a hybrid construction machine described in JP2009-281535A, for example, once a certain trouble occurs in an electrical circuit, even if an attempt is made to stop the turning regeneration because the pressure of the turning motor decreases, the electromagnetic switching valve remains switched to the open position and controllability of the turning motor may be deteriorated.

The present invention aims to improve fail-safe performance at the time of turning regeneration.

According to an aspect of the present invention, a control system for hybrid construction machine, includes: a fluid pressure pump which is a drive source of a turning motor; a regeneration motor for regeneration configured to be rotated by working fluid introduced from a turning circuit for driving the turning motor; a rotating electric machine which is coupled to the regeneration motor; a pressure detector configured to detect a turning pressure during a turning operation of the turning motor or a braking pressure during a braking operation of the turning motor; a controller configured to execute a regeneration control of the hybrid construction machine; a switching valve for turning regeneration configured to be switched by a pressure of supplied pilot fluid and performs turning regeneration by introducing the working fluid from the turning circuit to the regeneration motor when being switched to an open position; an electromagnetic proportional pressure reducing valve configured to be switched to an open position in response to a command from the controller and generates a pilot secondary pressure for switching the switching valve for turning regeneration to the open position when a pressure detected by the pressure detector reaches a first set pressure set in advance; and a pilot switching valve configured to be provided in series with the electromagnetic proportional pressure reducing valve and allows the passage of the pilot fluid for switching the switching valve for turning regeneration to the open position by being switched to an open position using a pressure of the turning circuit as a pilot pressure when the pressure of the turning circuit reaches a second set pressure set in advance.

DESCRIPTION OF EMBODIMENTS

Hereinafter, control systems for hybrid construction machine according to embodiments of the present invention are described with reference to the drawings. In each of the following embodiments, a case is described where a hybrid construction machine is a hydraulic shovel.

First Embodiment

Hereinafter, a control system 100 for hybrid construction machine according to a first embodiment of the present invention is described with reference to FIGS. 1 and 2.

Figure 1:
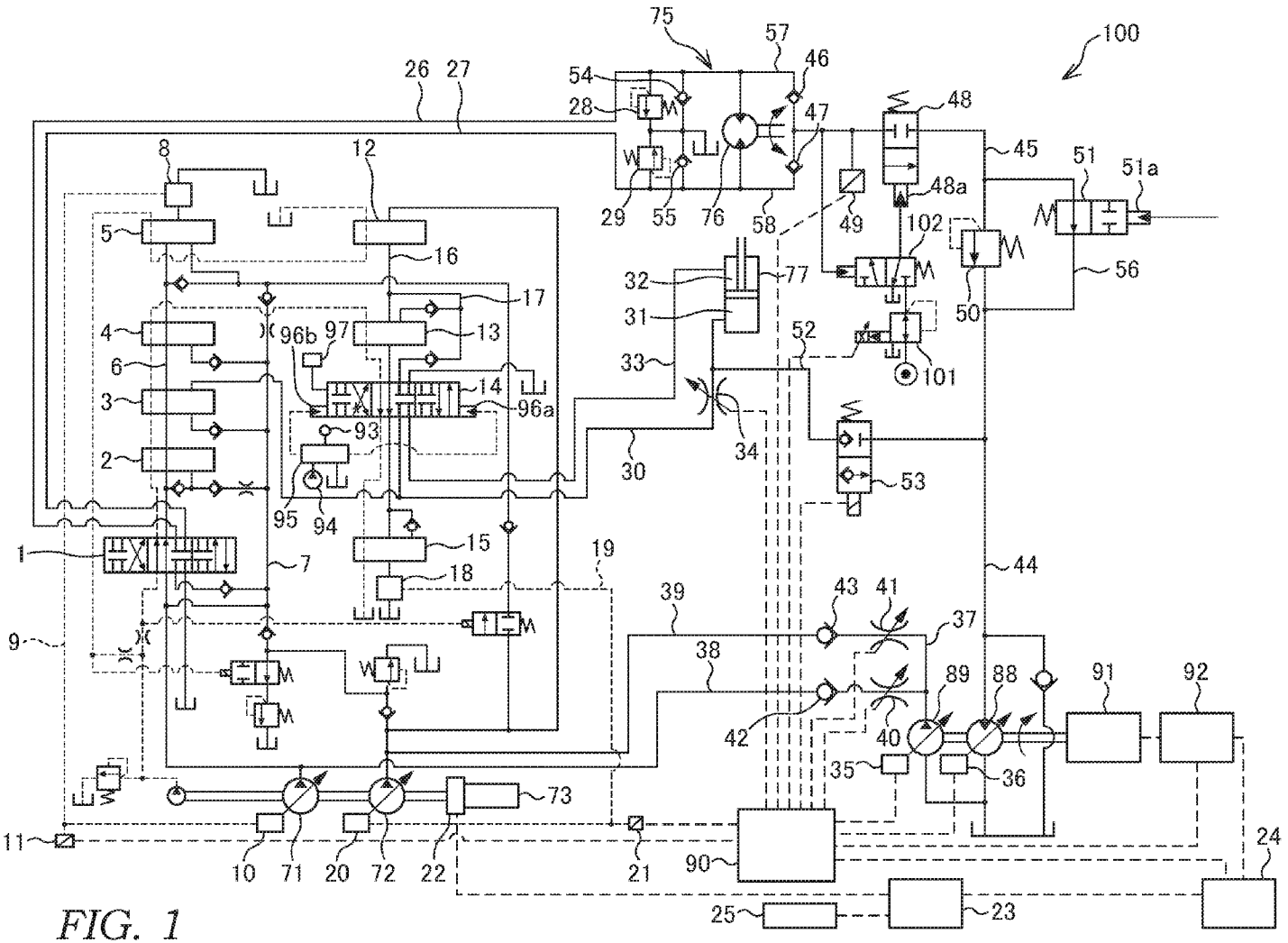
FIG. 1 is a circuit diagram showing a control system for hybrid construction machine according to a first embodiment of the present invention.

As shown in FIG. 1, a hydraulic shovel includes first and second main pumps 71, 72 as fluid pressure pumps driven by an engine 73. The first and second main pumps 71, 72 are variable displacement pumps capable of adjusting a tilt angle of a swash plate and coaxially rotate.

Hydraulic oil (working fluid) discharged from the first main pump 71 is successively supplied to an operation valve 1 for controlling a turning motor 76, an operation valve 2 for arm first speed for controlling an arm cylinder (not shown), an operation valve 3 for boom second speed for controlling a boom cylinder 77 as a fluid pressure cylinder, an operation valve 4 for controlling an auxiliary attachment (not shown) and an operation valve 5 for controlling a first travel motor for left travel (not shown) from an upstream side. Each operation valve 1 to 5 controls the operation of each actuator by controlling a flow rate of the hydraulic oil introduced to each actuator from the first main pump 71. Each operation valve 1 to 5 is operated by a pilot pressure supplied as an operator of the hydraulic shovel manually operates an operation lever.

Each operation valve 1 to 5 is connected to the first main pump 71 through a neutral flow passage 6 and a parallel flow passage 7 parallel to each other. A pilot pressure generation mechanism 8 for generating a pilot pressure is provided downstream of the operation valve 5 in the neutral flow passage 6. The pilot pressure generation mechanism 8 generates a high pilot pressure on an upstream side if a flow rate of the passing hydraulic oil is large while generating a low pilot pressure on the upstream side if the flow rate of the passing hydraulic oil is small.

The neutral flow passage 6 introduces all or part of the hydraulic oil discharged from the first main pump 71 to a tank when all the operation valves 1 to 5 are at or near a neutral position. At this time, the flow rate passing through the pilot pressure generation mechanism 8 increases, wherefore a high pilot pressure is generated.

On the other hand, if the operation valves 1 to 5 are switched to a full stroke, the neutral flow passage 6 is closed and the hydraulic oil no longer passes. In this case, there is almost no flow rate passing through the pilot pressure generation mechanism 8 and the pilot pressure is kept at zero. However, depending on operation amounts of the operation valves 1 to 5, a part of the hydraulic oil discharged from the first main pump 71 is introduced to the actuators and the remaining hydraulic oil is introduced to the tank from the neutral flow passage 6. Thus, the pilot pressure generation mechanism 8 generates a pilot pressure corresponding to the flow rate of the hydraulic oil in the neutral flow passage 6. That is, the pilot pressure generation mechanism 8 generates a pilot pressure corresponding to the operation amounts of the operation valves 1 to 5.

A pilot flow passage 9 is connected to the pilot pressure generation mechanism 8 and the pilot pressure generated in the pilot pressure generation mechanism 8 is introduced to the pilot flow passage 9. The pilot flow passage 9 is connected to a regulator 10 for controlling the tilt angle of the swash plate of the first main pump 71. The regulator 10 controls a displacement amount per rotation of the first main pump 71 by controlling the tilt angle of the swash plate of the first main pump 71 in proportion to (proportionality constant is a negative number) the pilot pressure in the pilot flow passage 9. Thus, if the operation valves 1 to 5 are switched to the full stroke, there is no more flow in the neutral flow passage 6 and the pilot pressure in the pilot flow passage 9 becomes zero, the tilt angle of the swash plate of the first main pump 71 is maximized to maximize the displacement amount per rotation.

A first pressure sensor 11 for detecting a pressure in the pilot flow passage 9 is provided in the pilot flow passage 9.

The hydraulic oil discharged from the second main pump 72 is successively supplied to an operation valve 12 for controlling a second travel motor for right travel (not shown), an operation valve 13 for controlling a bucket cylinder (no shown), an operation valve 14 for boom first speed for controlling the boom cylinder 77 and an operation valve 15 for arm second speed for controlling the arm cylinder (not shown) from an upstream side. Each operation valve 12 to 15 controls the operation of each actuator by controlling a flow rate of the hydraulic oil introduced to each actuator from the second main pump 72. Each operation valve 12 to 15 is operated by the pilot pressure supplied as the operator of the hydraulic shovel manually operates an operation lever.

Each operation valve 12 to 15 is connected to the second main pump 72 through a neutral flow passage 16. Further, the operation valves 13 and 14 are connected to the second main pump 72 through a parallel passage 17 parallel to the neutral flow passage 16. A pilot pressure generation mechanism 18 for generating a pilot pressure is provided downstream of the operation valve 15 in the neutral flow passage 16. The pilot pressure generation mechanism 18 has the same function as the pilot pressure generation mechanism 8 on the side of the first main pump 71.

A pilot flow passage 19 is connected to the pilot pressure generation mechanism 18 and the pilot pressure generated in the pilot pressure generation mechanism 18 is introduced to the pilot flow passage 19. The pilot flow passage 19 is connected to a regulator 20 for controlling the tilt angle of the swash plate of the second main pump 72. The regulator 20 controls a displacement amount per rotation of the second main pump 72 by controlling the tilt angle of the swash plate of the second main pump 72 in proportion to (proportionality constant is a negative number) the pilot pressure in the pilot flow passage 19. Thus, if the operation valves 12 to 15 are switched to the full stroke, there is no more flow in the neutral flow passage 16 and the pilot pressure in the pilot flow passage 19 becomes zero, the tilt angle of the swash plate of the second main pump 72 is maximized to maximize the displacement amount per rotation.

A second pressure sensor 21 for detecting a pressure in the pilot flow passage 19 is provided in the pilot flow passage 19.

The engine 73 is provided with a generator 22 for generating power utilizing the excess capacity of the engine 73. Power generated by the generator 22 is charged into a battery 24 via a battery charger 23. The battery charger 23 can charge power into the battery 24 also in the case of being connected to a normal household power supply 25.

Next, the turning motor 76 is described.

The turning motor 76 is provided in a turning circuit 75 for driving the turning motor 76. The turning circuit 75 includes a pair of supply/discharge passages 26, 27 which connect the first main pump 71 and the turning motor 76 and between which the operation valve 1 is disposed, and relief valves 28, 29 which are respectively connected to the supply/discharge passages 26, 27 and opened at a set pressure.

When the operation valve 1 is at the neutral position (state shown in FIG. 1), the supply and discharge of the hydraulic oil to and from the turning motor 76 are shut off and the turning motor 76 is kept in a stopped state since an actuator port of the operation valve 1 is closed.

When the operation valve 1 is switched to a right position in FIG. 1, the supply/discharge passage 26 is connected to the first main pump 71 and the supply/discharge passage 27 communicates with the tank. This causes the hydraulic oil to be supplied through the supply/discharge passage 26, whereby the turning motor 76 rotates and the return hydraulic oil from the turning motor 76 is discharged to the tank through the supply/discharge passage 27. On the other hand, if the operation valve 1 is switched to a left position in FIG. 1, the supply/discharge passage 27 is connected to the first main pump 71, the supply/discharge passage 26 communicates with the tank and the turning motor 76 rotates in a reverse direction.

If a turning pressure of the supply/discharge passages 26, 27 reaches the set pressure of the relief valves 28, 29 during a turning operation of the turning motor 76, the relief valves 28, 29 are opened and the hydraulic oil of an excess flow rate on a high-pressure side is introduced to a low-pressure side.

If the operation valve 1 is switched to the neutral position during the turning operation of the turning motor 76, the actuator port of the operation valve 1 is closed and a closed circuit is configured by the supply/discharge passages 26, 27, the turning motor 76 and the relief valves 28, 29. Even if the actuator port of the operation valve 1 is closed in this way, the turning motor 76 continues to rotate by inertia energy and exhibits a pump action.

This causes one of the pressures in the supply/discharge passages 26, 27, which was a low pressure during the turning operation, to become a high pressure and the other, which was a high pressure during the turning operation, to become a low pressure, whereby a braking force is applied to the turning motor 76 to perform a braking operation. At this time, if a braking pressure of the supply/discharge passages 26, 27 reaches the set pressure of the relief valves 28, 29, the relief valves 28, 29 are opened and the hydraulic oil of a brake flow rate on the high-pressure side is introduced to the low-pressure side.

If a suction flow rate of the turning motor 76 is insufficient during a braking operation of the turning motor 76, the hydraulic oil of the tank is sucked through check valves 54, 55 which allow only the flows of the hydraulic oil from the tank to the supply/discharge passages 26, 27.

Next, the boom cylinder 77 is described.

The operation valve 14 for controlling the operation of the boom cylinder 77 is operated by the pilot pressure supplied to pilot chambers 96*a*, 96*b* through a pilot valve 95 from a pilot pump 94 as the operator of the hydraulic shovel manually operates an operation lever 93. The operation valve 3 for boom second speed is switched in conjunction with the operation valve 14.

If the pilot pressure is supplied to the pilot chamber 96*a*, the operation valve 14 is switched to a right position in FIG. 1, the hydraulic oil discharged from the second main pump 72 is supplied to a piston-side chamber 31 of the boom cylinder 77 through a supply/discharge passage 30 and the return hydraulic oil from a rod-side chamber 32 is discharged to the tank through a supply/discharge passage 33, whereby the boom cylinder 77 extends.

On the other hand, if the pilot pressure is supplied to the pilot chamber 96*b*, the operation valve 14 is switched to a left position in FIG. 1, the hydraulic oil discharged from the second main pump 72 is supplied to the rod-side chamber 32 of the boom cylinder 77 through the supply/discharge passage 33 and the return hydraulic oil from the piston-side chamber 31 is discharged to the tank through the supply/discharge passage 30, whereby the boom cylinder 77 contracts.

If no pilot pressure is supplied to the pilot chambers 96*a*, 96*b*, the operation valve 14 is switched to the neutral position (state shown in FIG. 1) and the supply and discharge of the hydraulic oil to and from the boom cylinder 77 are shut off and the boom is kept in a stopped state.

If the operation valve 14 is switched to the neutral position to stop the movement of the boom, a force in a contracting direction is applied to the boom cylinder 77 due to the weights themselves of a bucket, the arm, the boom and the like. As just described, the boom cylinder 77 holds a load by the piston-side chamber 31 when the operation valve 14 is at the neutral position, and the piston-side chamber 31 serves as a load-side pressure chamber.

The control system 100 for hybrid construction machine includes a regeneration device for regenerating energy by collecting energy of the hydraulic oil from the turning circuit 75 and the boom cylinder 77. This regeneration device is described below.

A regeneration control by the regeneration device is executed by a controller 90. The controller 90 includes a CPU for executing the regeneration control, a ROM storing a control program, set values and the like necessary for a processing operation of the CPU, a RAM for temporarily storing information detected by various sensors.

First, a turning regeneration device for regenerating energy utilizing the hydraulic oil from the turning circuit 75 is described.

Branch passages 57, 58 are respectively connected to the supply/discharge passages 26, 27 connected to the turning motor 76. The branch passages 57, 58 join and are connected to a turning regeneration passage 45 for introducing the hydraulic oil from the turning circuit 75 to a regeneration motor 88 for regeneration. Check valves 46, 47 for allowing only the flows of the hydraulic oil from the supply/discharge passages 26, 27 to the turning regeneration passage 45 are respectively provided in the branch passages 57, 58. The turning regeneration passage 45 is connected to the regeneration motor 88 through a joint regeneration passage 44.

The regeneration motor 88 is a variable displacement motor capable of adjusting a tilt angle of a swash plate and coupled to an electric motor 91 as a rotating electric machine, which doubles as a generator, to coaxially rotate. When the electric motor 91 functions as a generator, power generated by the electric motor 91 is charged into the battery 24 via an inverter 92. The regeneration motor 88 and the electric motor 91 may be directly coupled or may be coupled via a speed reducer.

A switching valve 48 as a switching valve for turning regeneration controlled to be switched by a pressure of pilot fluid supplied based on a signal output from the controller 90 is provided in the turning regeneration passage 45. A pressure sensor 49 as a pressure detector for detecting a turning pressure during the turning operation of the turning motor 76 or a braking pressure during the braking operation of the turning motor 76 is provided between the switching valve 48 and the check valves 46, 47. A pressure signal detected by the pressure sensor 49 is output to the controller 90.

The switching valve 48 is set to a closed position (state shown in FIG. 1) to shut off the turning regeneration passage 45 when no pilot pressure is supplied to a pilot chamber 48*a*. The switching valve 48 is set to an open position to open the turning regeneration passage 45 when the pilot pressure is supplied to the pilot chamber 48*a*. When being switched to the open position, the switching valve 48 introduces the hydraulic oil from the turning circuit 75 to the regeneration motor 88. In this way, the turning regeneration is performed. As just described, the switching valve 48 is for performing the turning regeneration.

Figure 2:
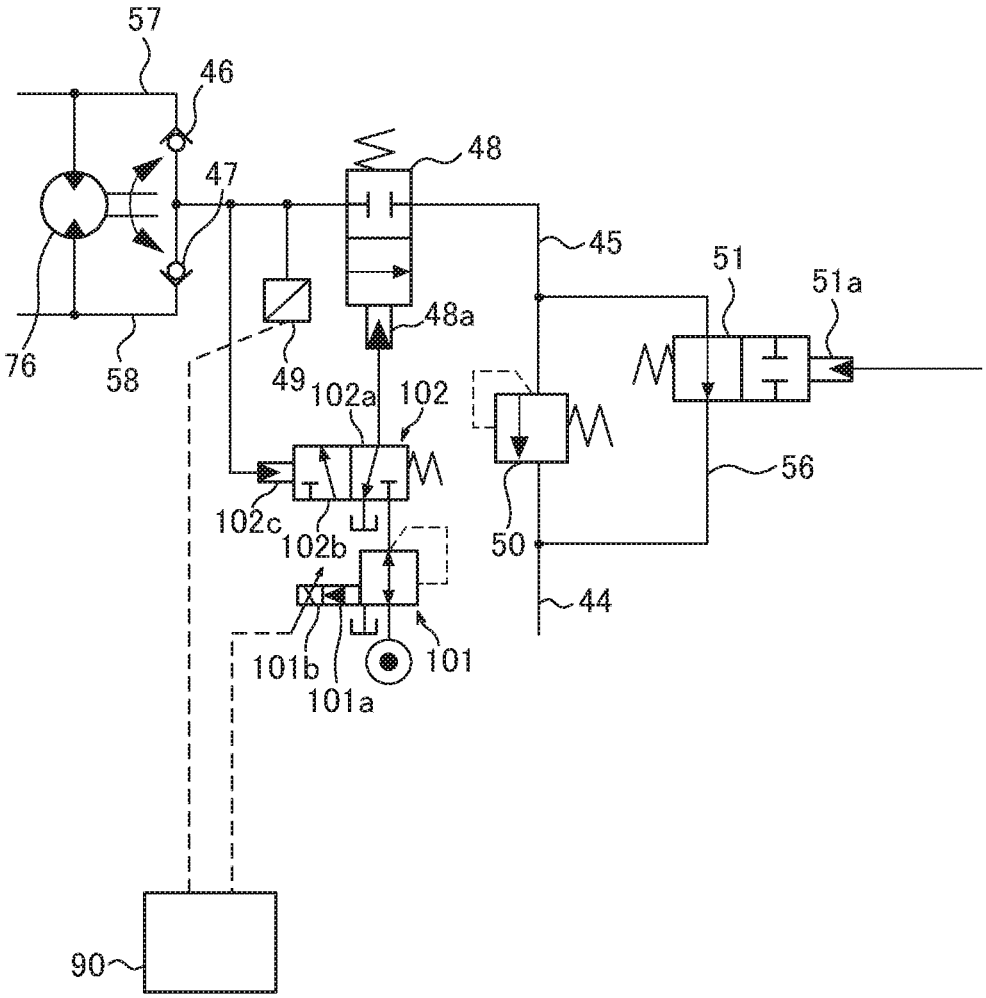
FIG. 2 is an enlarged view of an essential part in FIG. 1.

As shown in FIG. 2, an electromagnetic proportional pressure reducing valve 101 to be switched to an open position in response to a valve opening command from the controller 90 when the pressure detected by the pressure sensor 49 reaches a first set pressure set in advance and a three-way valve 102 as a pilot switching valve to be switched to a supply position (open position) 102*b* using a pressure of the turning circuit 75 as a pilot pressure when the pressure of the turning circuit 75 reaches a second set pressure set in advance are provided to supply the pilot pressure for switching the switching valve 48.

The switching valve 48 is switched by introducing the pilot fluid from a pilot pump driven by the engine 73 to the pilot chamber 48*a*. Instead of this, the switching valve 48 may be switched by reducing the pressure of the turning circuit 75 for switching the three-way valve 102 to the supply position 102*b* and introducing the reduced pressure to the pilot chamber 48*a*.

The electromagnetic proportional pressure reducing valve 101 generates a pilot secondary pressure for switching the switching valve 48 to the open position in response to a valve opening command from the controller 90. The pilot secondary pressure generated by the electromagnetic proportional pressure reducing valve 101 is introduced to the three-way valve 102. The electromagnetic proportional pressure reducing valve 101 does not output the pilot secondary pressure in a state where the valve opening command is not input from the controller 90.

When the valve opening command from the controller 90 is input, an electromagnetic force of a solenoid 101*b* proportionally changes according to a command value and the electromagnetic proportional pressure reducing valve 101 generates a pilot secondary pressure corresponding to the electromagnetic force. Thus, the electromagnetic proportional pressure reducing valve 101 can proportionally adjust the pilot secondary pressure according to the valve opening command from the controller 90.

The three-way valve 102 is provided in series with the electromagnetic proportional pressure reducing valve 101.

The three-way valve 102 has a discharge position (closed position) 102*a* where the pilot fluid in the pilot chamber 48*a* can be discharged and the supply position (open position) 102*b* where the pilot fluid can be supplied to the pilot chamber 48*a* and includes a pilot chamber 102*c* to which the pressure of the turning circuit 75 is introduced as a pilot pressure.

The three-way valve 102 enables the passage of the pilot fluid for switching the switching valve 48 to the open position when the pressure of the turning circuit 75 is introduced to the pilot chamber 102*c* and the three-way valve 102 is switched to the supply position 102*b*. A pressure upstream of the switching valve 48 for controlling the passage of the hydraulic oil introduced from the turning circuit 75 is introduced as the pilot pressure to the pilot chamber 102*c* of the three-way valve 102. The pilot fluid having passed through the three-way valve 102 is introduced to the pilot chamber 48*a* of the switching valve 48.

The first set pressure is set at a turning regeneration starting pressure at which the turning regeneration is started. The second set pressure is set lower than the first set pressure. Thus, if the pressure of the turning circuit 75 rises, the three-way valve 102 is first switched to the supply position 102*b* when the second set pressure is reached. When the pressure of the turning circuit 75 further rises to reach the first set pressure, the pilot secondary pressure is output in response to the valve opening command from the controller 90.

As just described, if the pressure of the turning circuit 75 rises, the three-way valve 102 is first switched to the supply position 102*b* and waits on standby to introduce the pilot fluid to the pilot chamber 48*a*. When the pressure of the turning circuit 75 reaches the turning regeneration starting pressure at which the turning regeneration is started, the electromagnetic proportional pressure reducing valve 101 outputs the pilot secondary pressure and the pilot fluid is actually introduced to the pilot chamber 48*a*. As just described, the switching valve 48 can be switched to the open position only when the pressure of the turning circuit 75 is not lower than a predetermined pressure.

Thus, by using the switching valve 48 that is a pilot switching valve, an uncontrolled turning can be stopped as compared with the case where an electromagnetic switching valve is used as a switching valve for turning regeneration since the switching valve 48 is switched to the closed position when the self-turning pressure of the turning circuit 75 decreases even if a certain trouble occurs in an electric circuit. In other words, since the turning regeneration is performed after the turning pressure becomes not lower than the predetermined pressure, an electrical malfunction can be prevented if the turning pressure is not higher than the predetermined pressure.

As described above, the switching valve 48 is switched to the open position where the pilot fluid is supplied to the pilot chamber 48*a* to perform the turning regeneration by having the pilot fluid supplied to the pilot chamber 48*a* when the electromagnetic proportional pressure reducing valve 101 to be switched by a command from the controller 90 and the three-way valve 102 to be switched using the pressure of the turning circuit 75 as the pilot pressure are both switched to the open position. Thus, even when a certain trouble occurs in an electrical circuit such as the controller 90 or the solenoid 101*b* of the electromagnetic proportional pressure reducing valve 101, the three-way valve 102 is switched to the discharge position 102*a* if the pressure of the working fluid introduced from the turning circuit 75 decreases. Thus, the pilot fluid is no longer supplied, wherefore the switching valve 48 is switched to the closed position. Therefore, fail-safe performance at the time of the turning regeneration can be improved.

The three-way valve 102 is arranged between the electromagnetic proportional pressure reducing valve 101 and the switching valve 48. In this case, the pilot pressure from the pilot pump is reduced by the electromagnetic proportional pressure reducing valve 101 and introduced to the three-way valve 102. Thus, the three-way valve 102 can be miniaturized. Without limitation to this, the sequence of the electromagnetic proportional pressure reducing valve 101 and the three-way valve 102 may be reversed and the electromagnetic proportional pressure reducing valve 101 may be arranged between the three-way valve 102 and the switching valve 48.

A course of the hydraulic oil from the turning circuit 75 to the regeneration motor 88 is described. For example, during the turning operation in which the turning motor 76 is turned by the hydraulic oil supplied through the supply/discharge passage 26, excess oil in the supply/discharge passage 26 flows into the turning regeneration passage 45 through the branch passage 57 and the check valve 46 to be introduced to the regeneration motor 88. Further, during the braking operation in which the operation valve 1 is switched to the neutral position when the turning motor 76 is turned by the hydraulic oil supplied through the supply/discharge passage 26, the hydraulic oil discharged by the pump action of the turning motor 76 flows into the turning regeneration passage 45 through the branch passage 58 and the check valve 47 to be introduced to the regeneration motor 88.

A pressure reducing valve 50 is provided downstream of the switching valve 48 in the turning regeneration passage 45. The pressure reducing valve 50 is a differential pressure constant type valve which operates such that a differential pressure between an inlet and an outlet is a constant value.

A bypass passage 56 bypassing the pressure reducing valve 50 is connected to the turning regeneration passage 45. A bypass valve 51 having a shut-off position and a communication position is provided in the bypass passage 56. The bypass valve 51 is a switching valve of a pilot operation type. The bypass valve 51 is set at the communication position (state shown in FIG. 1) in a normal state where no pilot pressure is supplied to a pilot chamber 51*a* and set to the shut-off position by having the same pilot pressure simultaneously supplied to the pilot chamber 51*a* when the pilot pressure is supplied to a pilot chamber 96*b* of the operation valve 14. That is, the bypass valve 51 is set to the shut-off position by the pilot pressure for operating the operation valve 14 in a direction to contract the piston-side chamber 31 of the boom cylinder 77 and switched in conjunction with a contracting movement of the boom cylinder 77.

A regeneration control of the turning regeneration is described.

The controller 90 outputs a valve opening command to the electromagnetic proportional pressure reducing valve 101 to supply the pilot fluid to the pilot chamber 48*a* of the switching valve 48 when determining that the pressure detected by the pressure sensor 49 has reached the turning regeneration starting pressure. In this way, the switching valve 48 is switched to the open position to start the turning regeneration.

The controller 90 stops the valve opening command to the electromagnetic proportional pressure reducing valve 101 when determining that the pressure detected by the pressure sensor 49 has fallen below the turning regeneration starting pressure. In this way, the switching valve 48 is switched to the closed position to stop the turning regeneration.

Next, a boom regeneration device for regenerating energy utilizing the hydraulic oil from the boom cylinder 77 is described.

An electromagnetic proportional throttle valve 34 whose opening is controlled by an output signal of the controller 90 is provided in the supply/discharge passage 30 connecting the piston-side chamber 31 of the boom cylinder 77 and the operation valve 14. The electromagnetic proportional throttle valve 34 maintains a fully open position in a normal state.

A boom regeneration circuit 52 as a cylinder regeneration passage branched off between the piston-side chamber 31 and the electromagnetic proportional throttle valve 34 is connected to the supply/discharge passage 30. The boom regeneration circuit 52 is a passage for introducing the return hydraulic oil from the piston-side chamber 31 to the regeneration motor 88. The turning regeneration passage 45 and the boom regeneration passage 52 join and are connected to the joint regeneration passage 44.

A switching valve 53 as a switching valve for cylinder regeneration controlled to be switched by a signal output from the controller 90 is provided in the boom regeneration passage 52. The switching valve 53 is set to a closed position (state shown in FIG. 1) to shut off the boom regeneration passage 52 when a solenoid is not excited, and set to an open position to open the boom regeneration passage 52 when the solenoid is excited. The switching valves 48 and 53 are provided in parallel.

The operation valve 14 is provided with a sensor 97 for detecting an operating direction and an operation amount of the operation valve 14. A pressure signal detected by the sensor 97 is output to the controller 90. The detection of the operating direction and the operation amount of the operation valve 14 is equivalent to the detection of an extending/contracting direction and an extension/contraction amount of the boom cylinder 77. Thus, the sensor 97 functions as an operating state detector for detecting an operating state of the boom cylinder 77.

It should be noted that, instead of the sensor 97, the boom cylinder 77 may be provided with a sensor for detecting a moving direction and a moving amount of a piston rod as the operating state detector or the operation lever 93 may be provided with a sensor for detecting an operating direction and an operation amount of the operation lever 93 as the operating state detector.

The controller 90 determines based on a detection result of the sensor 97 whether the operator is trying to extend or contact the boom cylinder 77. When determining an extending movement of the boom cylinder 77, the controller 90 keeps the electromagnetic proportional throttle valve 34 at the fully open position, i.e. in the normal state and holds the switching valve 53 at the closed position.

On the other hand, when determining a contracting movement of the boom cylinder 77, the controller 90 calculates a contracting speed of the boom cylinder 77 required by the operator according to the operation amount of the operation valve 14, closes the electromagnetic proportional throttle valve 34 and switches the switching valve 53 to the open position. In this way, all the return hydraulic oil from the boom cylinder 77 is introduced to the regeneration motor 88 to perform the boom regeneration.

However, if a flow rate consumed by the regeneration motor 88 is less than a flow rate necessary to maintain the contracting speed of the boom cylinder 77 required by the operator, the boom cylinder 77 cannot maintain the contacting speed required by the operator. In such a case, the controller 90 controls the opening of the electromagnetic proportional throttle valve 34 to return the hydraulic oil of a flow rate more than the flow rate consumed by the regeneration motor 88 to the tank based on the operation amount of the operation valve 14, the tilt angle of the swash plate of the regeneration motor 88, a rotating speed of the electric motor 91 and the like, thereby maintaining the contracting speed of the boom cylinder 77 required by the operator.

Next, the operation of the bypass valve 51 is described. First, a case where only the turning regeneration is performed is described.

When determining that the pressure detected by the pressure sensor 49 has reached the turning regeneration starting pressure, the controller 90 outputs a valve opening command to the electromagnetic proportional pressure reducing valve 101 to supply the pilot fluid to the pilot chamber 48*a* of the switching valve 48. In this way, the switching valve 48 is switched to the open position to start the turning regeneration.

On the other hand, when determining based on a detection result of the sensor 97 that the boom cylinder 77 is being extended or stopped, the controller 90 sets the switching valve 53 to the closed position. In this way, the return hydraulic oil from the boom cylinder 77 is not introduced to the regeneration motor 88 and the boom regeneration is not performed.

Here, since the pilot pressure is not supplied to the pilot chamber 96*b* of the operation valve 14 when the boom cylinder 77 is being extended and stopped, the pilot pressure is also not supplied to the pilot chamber 51*a* of the bypass valve 51 and the bypass valve 51 is at the communication position. In this way, the hydraulic oil from the turning circuit 75 bypasses the pressure reducing valve 50 and is introduced to the regeneration motor 88 through the bypass valve 51.

As just described, the bypass valve 51 is set to the communication position and the hydraulic oil from the turning circuit 75 is introduced to the regeneration motor 88 without being reduced in pressure by the pressure reducing valve 50 when only the turning regeneration is performed. Thus, efficient regeneration is performed.

Here, since the hydraulic oil from the turning circuit 75 is introduced to the regeneration motor 88 without being reduced in pressure by the pressure reducing valve 50 when only the turning regeneration is performed, the pressure of the turning circuit 75 easily falls. When the pressure of the turning circuit 75 falls below the turning regeneration starting pressure, the switching valve 48 may be repeatedly opened and closed in such a way that the switching valve 48 is switched to the closed position to stop the turning regeneration, the pressure of the turning circuit 75, thereafter, rises again if the turning motor 76 is being turned, and the switching valve 48 is switched to the open position to resume the turning regeneration when the turning regeneration starting pressure is reached. If such a situation occurs, vibration may be generated due to a pressure variation caused by the opening and closing of the switching valve 48.

Accordingly, the controller 90 controls a regeneration flow rate introduced to the regeneration motor 88 by controlling the tilt angle of the swash plate and the rotating speed of the regeneration motor 88 so that the pressure detected by the pressure sensor 49 does not fall below the turning regeneration starting pressure when only the turning regeneration is performed. Specifically, the controller 90 calculates a theoretical turning regeneration flow rate from the pressure detected by the pressure sensor 49 and controls the tilt angle of the swash plate and the rotating speed of the regeneration motor 88 so that the regeneration flow rate introduced to the regeneration motor 88 does not exceed the theoretical turning regeneration flow rate. The theoretical turning regeneration flow rate is calculated using a map specifying a relationship between the pressure detected by the pressure sensor 49 and a relief flow rate flowing through the relief valves 28, 29.

That is, the controller 90 calculates the relief flow rate flowing through the relief valves 28, 29 (theoretical turning regeneration flow rate) from the pressure detected by the pressure sensor 49 by referring to the map and controls the regeneration flow rate introduced to the regeneration motor 88 so that the regeneration flow rate does not exceed the relief flow rate. In this way, the pressure of the turning circuit 75 can be kept at a pressure not to affect the turning operation or the braking operation of the turning motor 76 even when only the turning regeneration is performed and the hydraulic oil from the turning circuit 75 is introduced to the regeneration motor 88 without being reduced in pressure by the pressure reducing valve 50.

Next, a case is described where the turning regeneration and the boom regeneration are simultaneously performed.

The controller 90 outputs a valve opening command to the electromagnetic proportional pressure reducing valve 101 to supply the pilot fluid to the pilot chamber 48*a* of the switching valve 48 when determining that the pressure detected by the pressure sensor 49 has reached the turning regeneration starting pressure. In this way, the switching valve 48 is switched to the open position to start the turning regeneration. On the other hand, when determining based on a detection result of the sensor 97 that the boom cylinder 77 is being contracted, the controller 90 switches the switching valve 53 to the open position. In this way, the return hydraulic oil from the boom cylinder 77 is introduced to the regeneration motor 88 and the boom regeneration is performed.

Here, during the contracting movement of the boom cylinder 77, the pilot pressure is supplied to the pilot chamber 51*a* of the bypass valve 51 at the same time as the pilot pressure is supplied to the pilot chamber 96*b* of the operation valve 14. Thus, the bypass valve 51 is set to the shut-off position. In this way, the hydraulic oil from the turning circuit 75 is introduced to the regeneration motor 88 through the pressure reducing valve 50.

As just described, the bypass valve 51 is set to the shut-off position and the hydraulic oil from the turning circuit 75 is reduced in pressure by the pressure reducing valve 50 and introduced to the regeneration motor 88 when the turning regeneration and the boom regeneration are simultaneously performed. Thus, the hydraulic oil from the turning circuit 75 is reduced in pressure, joined with the return hydraulic oil from the boom cylinder 77 and introduced to the regeneration motor 88.

The pressure of the return hydraulic oil from the boom cylinder 77 is lower than the pressure of the hydraulic oil from the turning circuit 75. The pressure reducing valve 50 works to eliminate a differential pressure between the pressure of the return hydraulic oil from the boom cylinder 77 and that of the hydraulic oil from the turning circuit 75. That is, the hydraulic oil from the turning circuit 75 is reduced in pressure by the pressure reducing valve 50, whereby the hydraulic oil from the turning circuit 75 and the return hydraulic oil from the boom cylinder 77 stably join in the joint regeneration passage 44.

Further, as described above, vibration may be generated due to a pressure variation caused by the opening and closing of the switching valve 48 during the turning regeneration. However, since the hydraulic oil from the turning circuit 75 is reduced in pressure by the pressure reducing valve 50 when the turning regeneration and the boom regeneration are simultaneously performed, the pressure of the turning circuit 75 is a pressure obtained by adding a pressure loss of the pressure reducing valve 50 to the pressure of the regeneration motor 88. Thus, a pressure reduction of the turning circuit 75 can be prevented and the generation of vibration due to the pressure reduction of the turning circuit 75 can be prevented.

As described above, the bypass valve 51 is so controlled that the hydraulic oil from the turning circuit 75 is introduced to the regeneration motor 88 without being reduced in pressure by the pressure reducing valve 50 when only the turning regeneration is performed and the hydraulic oil from the turning circuit 75 is reduced in pressure by the pressure reducing valve 50 and introduced to the regeneration motor 88 when the turning regeneration and the boom regeneration are simultaneously performed. In this way, efficient regeneration can be performed by a simple regeneration control.

In the above embodiment, a case is described where the bypass valve 51 is a switching valve of the pilot operation type. Instead of this, the bypass valve 51 may be an electromagnetic valve. In this case, the bypass valve 51 is set to the shut-off position by a signal output from the controller 90 based on the detection result of the sensor 97. Specifically, the controller 90 switches the bypass valve 51 to the shut-off position when determining based on the detection result of the sensor 97 that the boom cylinder 77 is being contracted.

Further, in the above embodiment, a case utilizing the return hydraulic oil from the boom cylinder 77 is described as an example in which regeneration is performed utilizing return hydraulic oil from a fluid pressure cylinder. However, regeneration may be performed utilizing return hydraulic oil from the arm cylinder for driving the arm or the bucket cylinder for driving the bucket instead of the boom cylinder 77. Since the arm cylinder and the bucket cylinder are often in a state where a load is held by a rod-side chamber when the operation valves 2, 13 are at the neutral position, the rod-side chamber may serve as a load-side pressure chamber.

Next, an auxiliary pump 89 for assisting outputs of the first and second main pumps 71, 72 is described. The auxiliary pump 89 is a variable displacement pump capable of adjusting a tilt angle of a swash plate and coupled to the regeneration motor 88 to coaxially rotate. The auxiliary pump 89 is rotated by a drive force of the electric motor 91. The rotating speed of the electric motor 91 is controlled by the controller 90 through the inverter 92. The tilt angles of the swash plates of the auxiliary pump 89 and the regeneration pump 88 are controlled by the controller 90 through tilt angle controllers 35, 36.

A discharge passage 37 is connected to the auxiliary pump 89. The discharge passage 37 is branched into a first assist flow passage 38 which joins a discharge side of the first main pump 71 and a second assist flow passage 39 which joins a discharge side of the second main pump 72. First and second electromagnetic proportional throttle valves 40, 41 whose openings are controlled by output signals of the controller 90 are provided in the respective first and second assist flow passages 38, 39. Further, check valves 42, 43 for allowing only the flows of the hydraulic oil from the auxiliary pump 89 to the first and second main pumps 71, 72 are provided downstream of the first and second electromagnetic proportional throttle valves 40, 41 in the respective first and second assist flow passages 38, 39.

When being rotated by a drive force of the electric motor 91, the auxiliary pump 89 assists outputs of the first and second main pumps 71, 72. The controller 90 controls the openings of the first and second electromagnetic proportional throttle valves 40, 41 in accordance with pressure signals from the first and second pressure sensors 11, 21 and distributes and supplies the hydraulic oil discharged from the auxiliary pump 89 to the discharge sides of the first and second main pumps 71, 72.

When the hydraulic oil is supplied to the regeneration motor 88 through the joint regeneration passage 44 and the regeneration motor 88 rotates, a rotational force of the regeneration motor 88 acts as an assist force for the coaxially rotating electric motor 91. Thus, power consumption of the electric motor 91 can be reduced by as much as the rotational force of the regeneration motor 88.

When the electric motor 91 is used as a generator using the regeneration motor 88 as a drive source, the tilt angle of the swash plate of the auxiliary pump 89 is set to zero and a substantially no-load state is set.

According to the above first embodiment, the following effects are exhibited.

The switching valve 48 is switched to the open position where the pilot fluid is supplied to the pilot chamber 48*a* and the turning regeneration is performed when the electromagnetic proportional pressure reducing valve 101 to be switched by a command from the controller 90 and the three-way valve 102 to be switched using the pressure of the turning circuit 75 as a pilot pressure are both switched to the open position. Thus, even when a certain trouble occurs in an electrical circuit such as the controller 90 or the solenoid 101*b* of the electromagnetic proportional pressure reducing valve 101, the three-way valve 102 is switched to the discharge position 102*a* if the pressure of the working fluid introduced from the turning circuit 75 decreases. Thus, the pilot fluid is no longer supplied, wherefore the switching valve 48 is switched to the closed position. Therefore, fail-safe performance at the time of the turning regeneration can be improved.

Further, in the regeneration control of the present embodiment, the hydraulic oil from the turning circuit 75 is introduced to the regeneration motor 88 without being reduced in pressure by the pressure reducing valve 50 when only the turning regeneration is performed and the hydraulic oil from the turning circuit 75 is reduced in pressure by the pressure reducing valve 50 and introduced to the regeneration motor 88 when the turning regeneration and the boom regeneration are simultaneously performed. Thus, a control is simple. Further, since the hydraulic oil from the turning circuit 75 is introduced to the regeneration motor 88 without being reduced in pressure when only the turning regeneration is performed, efficient regeneration is performed. Therefore, efficient regeneration is possible by a simple regeneration control.

Second Embodiment

Figure 3:
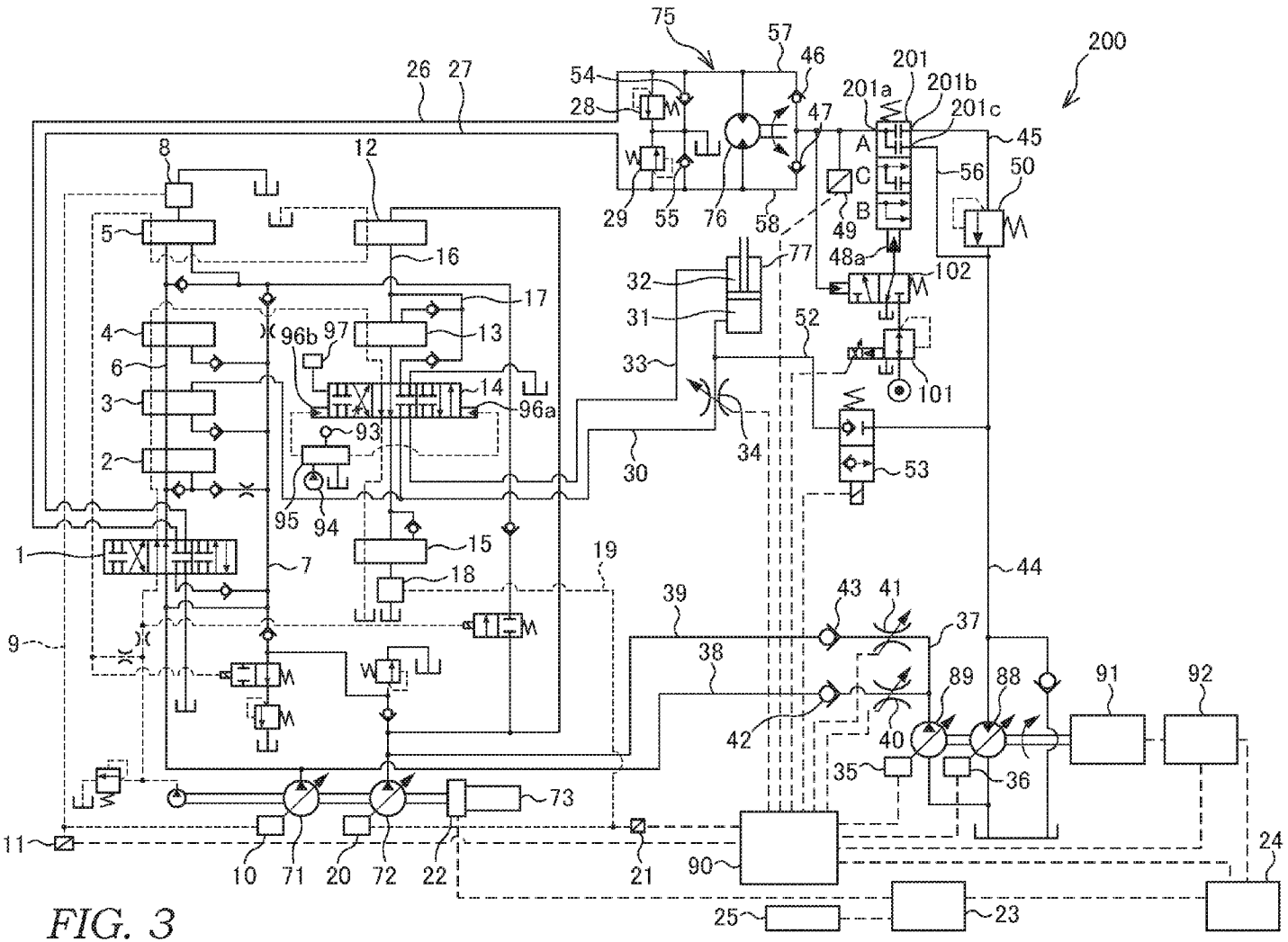
FIG. 3 is a circuit diagram showing a control system for hybrid construction machine according to a second embodiment of the present invention.

A control system 200 for hybrid construction machine according to a second embodiment of the present invention is described below with reference to FIG. 3. In each aspect of the following embodiments, different points from the aforementioned first embodiment are mainly described and components having functions similar to those of the first embodiment are denoted by the same reference signs and not described.

In the control system 200 for hybrid construction machine, a switching valve 201 as a switching valve for turning regeneration having the functions of the switching valve 48 and the bypass valve 51 of the aforementioned first embodiment is provided in a turning regeneration path 45.

The switching valve 201 is a pilot switching valve having three positions, i.e. a shut-off position A, a first communication position B and a second communication position C and having the position thereof switched by a pressure of pilot fluid supplied based on an output signal of a controller 90. Further, the switching valve 201 has three ports, i.e. an inlet port 201*a* to which a pressure of a turning circuit 75 is introduced, an outlet port 201*b* which communicates with a pressure reducing valve 50 and a bypass port 201C which communicates with a bypass passage 56. The bypass passage 56 connects the bypass port 201*c* of the switching valve 201 and a side downstream of the pressure reducing valve 50 in the turning regeneration path 45.

At the shut-off position A of the switching valve 201, the communication of the outlet port 201*b* and the bypass port 201C with the inlet port 201*a* is shut off. At the first communication position B, the outlet port 201*b* and the bypass port 201C communicate with the inlet port 201*a*. At the second communication position C, the outlet port 201*b* communicates with the inlet port 201*a* and the communication of the bypass port 201C with the inlet port 201*a* is shut off.

The controller 90 stops a valve opening command to an electromagnetic proportional pressure reducing valve 101 to set the switching valve 201 to the shut-off position A when determining that a pressure detected by a pressure sensor 49 is below a turning regeneration starting pressure. At the shut-off position A, hydraulic oil from the turning circuit 75 is not introduced to a regeneration motor 88 and turning regeneration is not performed.

Further, the controller 90 outputs a valve opening command to the electromagnetic proportional pressure reducing valve 101 to set the switching valve 201 to the first communication position B and set a switching valve 53 to a closed position when determining that the pressure detected by the pressure sensor 49 has reached the turning regeneration starting pressure and a boom cylinder 77 is being extended or stopped based on a detection result of a sensor 97. That is, the switching valve 201 is set to the first communication position B when the pressure detected by the pressure sensor 49 reaches the turning regeneration starting pressure and the switching valve 53 is at the closed position.

In this way, only the hydraulic oil from the turning circuit 75 is introduced to the regeneration motor 88 and only the turning regeneration is performed. At this time, since the bypass passage 56 is opened at the switching valve 201, the hydraulic oil from the turning circuit 75 is introduced to the regeneration motor 88 while bypassing the pressure reducing valve 50. As just described, the hydraulic oil from the turning circuit 75 is introduced to the regeneration motor 88 without being reduced in pressure by the pressure reducing valve 50 when only the turning regeneration is performed.

Further, the controller 90 outputs a valve opening command to the electromagnetic proportional pressure reducing valve 101 to set the switching valve 201 to the second communication position C and set the switching valve 53 to an open position when determining that the pressure detected by the pressure sensor 49 has reached the turning regeneration starting pressure and the boom cylinder 77 is being contracted based on the detection result of the sensor 97. That is, the switching valve 201 is set to the second communication position C when the pressure detected by the pressure sensor 49 reaches the turning regeneration starting pressure and the switching valve 53 is at the open position.

In this way, the hydraulic oil from the turning circuit 75 and return hydraulic oil from the boom cylinder 77 are introduced to the regeneration motor 88 and the turning regeneration and boom regeneration are simultaneously performed. At this time, since the turning regeneration passage 45 is opened at the switching valve 201 and, on the other hand, the bypass passage 56 is shut off, the hydraulic oil from the turning circuit 75 is introduced to the regeneration motor 88 through the pressure reducing valve 50. As just described, the hydraulic oil from the turning circuit 75 is reduced in pressure by the pressure reducing valve 50 and introduced to the regeneration motor 88 when the turning regeneration and the boom regeneration are simultaneously performed.

The controller 90 outputs such a valve opening command as to generate a higher pilot secondary pressure by the electromagnetic proportional pressure reducing valve 101 in the case of a switch to the first communication position B than in the case of a switch to the second communication position C. This causes the pressure of the pilot fluid supplied to a pilot chamber 48*a* of the switching valve 201 to be higher in the case of the switch to the first communication position B than in the case of the switch to the second communication position C. As just described, the switching valve 201 is switched to the first and second communication positions B, C depending on the magnitude of the pilot pressure supplied to the pilot chamber 48*a*.

According to the above second embodiment, functions and effects similar to those of the first embodiment are exhibited and, since the bypass valve 51, which is necessary in the first embodiment, is unnecessary, cost can be reduced.

Third Embodiment

Figure 4:
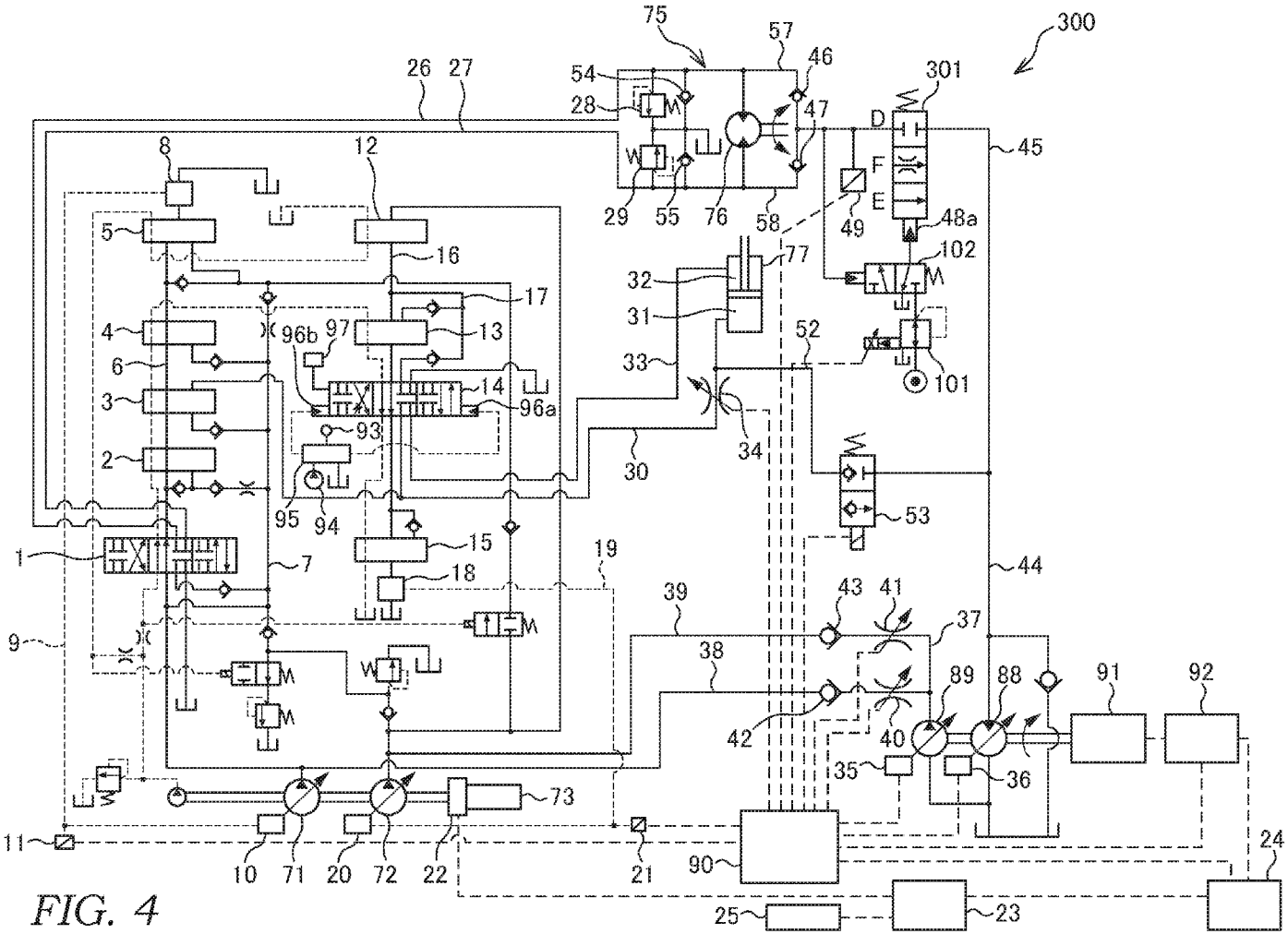
FIG. 4 is a circuit diagram showing a control system for hybrid construction machine according to a third embodiment of the present invention.

A control system 30*o* for hybrid construction machine according to a third embodiment of the present invention is described below with reference to FIG. 4.

In the control system 30*o* for hybrid construction machine, a switching valve 301 as a switching valve for turning regeneration having the functions of the switching valve 48, the pressure reducing valve 50 and the bypass valve 51 of the aforementioned first embodiment is provided in a turning regeneration path 45.

The switching valve 301 is a pilot switching valve having three positions, i.e. a shut-off position D, a first communication position E and a second communication position F and having the position thereof switched by a pressure of pilot fluid supplied based on an output signal of a controller 90. The switching valve 301 shuts off the turning regeneration passage 45 at the shut-off position D, introduces hydraulic oil from a turning circuit 75 to a regeneration motor 88 without reducing a pressure of the hydraulic oil at the first communication position E and introduces the hydraulic oil from the turning circuit 75 to the regeneration motor 88 while reducing the pressure thereof by throttling at the second communication position F.

The controller 90 stops a valve opening command to an electromagnetic proportional pressure reducing valve 101 to set the switching valve 301 to the shut-off position D when determining that a pressure detected by a pressure sensor 49 is below a turning regeneration starting pressure. At the shut-off position D, the hydraulic oil from the turning circuit 75 is not introduced to a regeneration motor 88 and turning regeneration is not performed.

Further, the controller 90 outputs a valve opening command to the electromagnetic proportional pressure reducing valve 101 to set the switching valve 301 to the first communication position E and set a switching valve 53 to a closed position when determining that the pressure detected by the pressure sensor 49 has reached the turning regeneration starting pressure and a boom cylinder 77 is being extended or stopped based on a detection result of a sensor 97. That is, the switching valve 301 is set to the first communication position E when the pressure detected by the pressure sensor 49 reaches the turning regeneration starting pressure and the switching valve 53 is at the closed position.

The controller 90 outputs such a valve opening command as to generate a higher pilot secondary pressure by the electromagnetic proportional pressure reducing valve 101 in the case of a switch to the first communication position E than in the case of a switch to the second communication position F. This causes the pressure of the pilot fluid supplied to a pilot chamber 48*a* of the switching valve 301 to be higher in the case of the switch to the first communication position E than in the case of the switch to the second communication position F. As just described, the switching valve 301 is switched to the first and second communication positions E, F depending on the magnitude of the pilot pressure supplied to the pilot chamber 48*a*.

In this way, only the hydraulic oil from the turning circuit 75 is introduced to the regeneration motor 88 and only the turning regeneration is performed. At this time, the hydraulic oil from the turning circuit 75 is introduced to the regeneration motor 88 without being reduced in pressure by the switching valve 301. As just described, the hydraulic oil from the turning circuit 75 is introduced to the regeneration motor 88 without being reduced in pressure when only the turning regeneration is performed.

Further, the controller 90 outputs a valve opening command to the electromagnetic proportional pressure reducing valve 101 to set the switching valve 301 to the second communication position F and set the switching valve 53 to an open position when determining that the pressure detected by the pressure sensor 49 has reached the turning regeneration starting pressure and the boom cylinder 77 is being contracted based on the detection result of the sensor 97. That is, the switching valve 301 is set to the second communication position F when the pressure detected by the pressure sensor 49 reaches the turning regeneration starting pressure and the switching valve 53 is at the open position.

In this way, the hydraulic oil from the turning circuit 75 and return hydraulic oil from the boom cylinder 77 are introduced to the regeneration motor 88 and the turning regeneration and boom regeneration are simultaneously performed. At this time, the hydraulic oil from the turning circuit 75 is introduced to the regeneration motor 88 while being throttled at the switching valve 301. As just described, the hydraulic oil from the turning circuit 75 is reduced in pressure by being throttled and introduced to the regeneration motor 88 when the turning regeneration and the boom regeneration are simultaneously performed.

According to the above third embodiment, functions and effects similar to those of the first and second embodiments are exhibited and, since the pressure reducing valve 50, the bypass passage 56 and the bypass valve 51, which are necessary in the first embodiment, are unnecessary, cost can be reduced.

Fourth Embodiment

Figure 5:
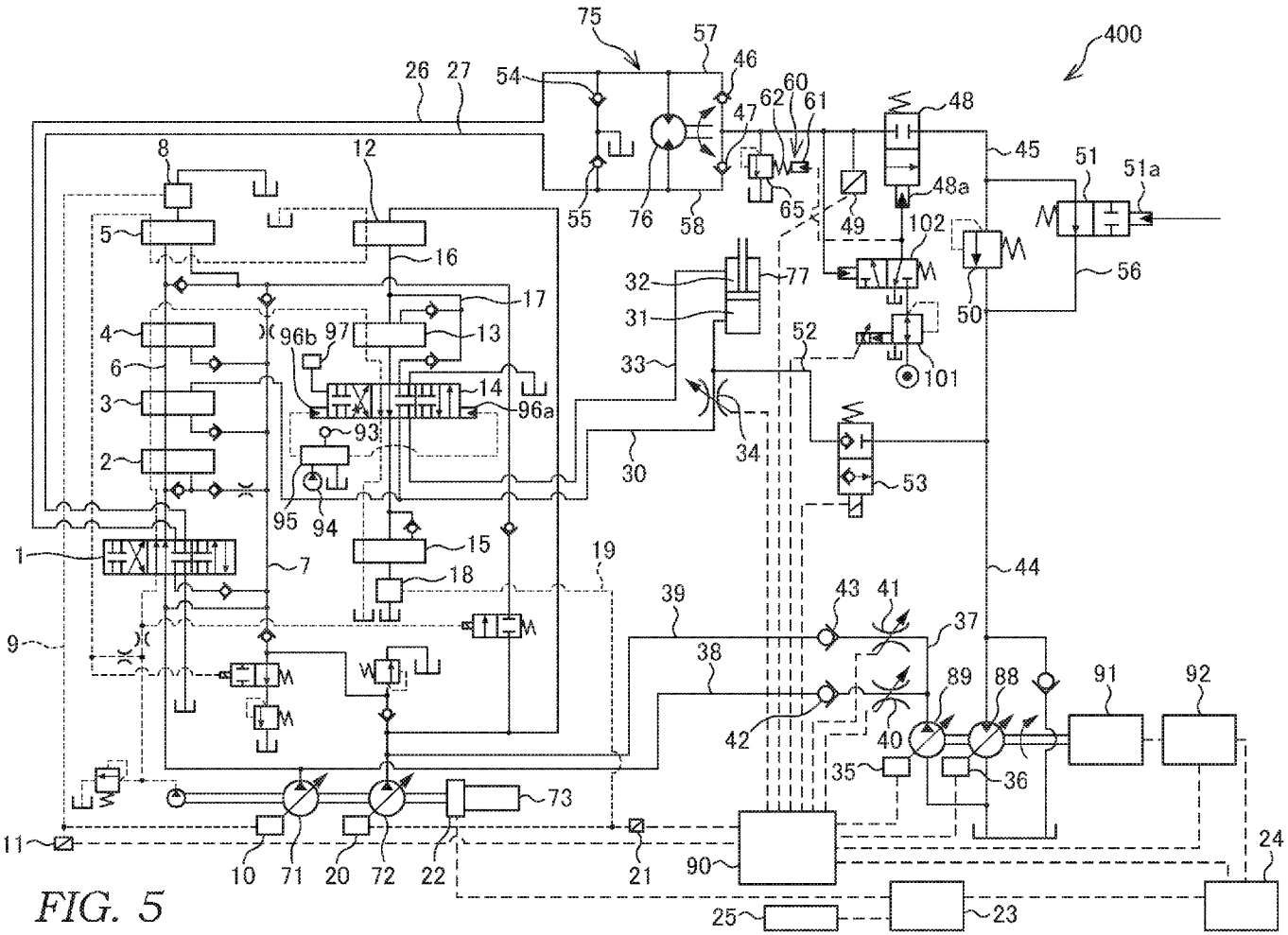
FIG. 5 is a circuit diagram showing a control system for hybrid construction machine according to a fourth embodiment of the present invention.

A control system 400 for hybrid construction machine according to a fourth embodiment of the present invention is described below with reference to FIG. 5.

The control system 400 for hybrid construction machine differs from each of the aforementioned embodiments in that a relief valve 65 capable of adjusting a set pressure is provided instead of the relief valves 28, 29.

The control system 400 for hybrid construction machine includes the relief valve 65 that is opened to allow the flow of working fluid toward a low-pressure side when a turning pressure during a turning operation of a turning motor 76 or a braking pressure during a braking operation of the turning motor 76 reaches a set pressure, and an adjuster 60 capable of adjusting the set pressure of the relief valve 65.

The relief valve 65 is provided at a position branched off from a side upstream of a switching valve 48 for hydraulic oil introduced from a turning circuit 75. The relief valve 65 is opened when a pressure of the turning circuit 75 becomes larger than a biasing force of a coil spring 62 as a biasing member. The set pressure of the relief valve 65 is determined by the biasing force of the coil spring 62.

The adjuster 60 increases the set pressure of the relief valve 65 by increasing the biasing force of the coil spring 62 by a pilot pressure introduced to a pilot chamber 61. A pressure of pilot fluid supplied from a pilot pump and having passed through an electromagnetic proportional pressure reducing valve 101 and a three-way valve 102 is supplied to the pilot chamber 61. Specifically, the pilot pressure is introduced to the pilot chamber 61 when a pressure detected by a pressure reducing valve 49 reaches a turning regeneration starting pressure while no pilot pressure is introduced to the pilot chamber 61 when the pressure detected by the pressure reducing valve 49 falls below the turning regeneration starting pressure.

Specifically, a signal is output from a controller 90 to the electromagnetic proportional pressure reducing valve 101 to open the electromagnetic proportional pressure reducing valve 101, whereby the pilot pressure is introduced to the pilot chamber 61, when the pressure detected by the pressure reducing valve 49 reaches the turning regeneration starting pressure. On the other hand, when the pressure detected by the pressure reducing valve 49 falls below the turning regeneration starting pressure, no pilot pressure is introduced to the pilot chamber 61 since no signal is output from the controller 90 to the electromagnetic proportional pressure reducing valve 101 and the electromagnetic proportional pressure reducing valve 101 is closed.

As just described, the adjuster 60 operates in such a manner that the set pressure of the relief valve 65 is increased from an initial set pressure when the pressure detected by the pressure reducing valve 49 reaches the turning regeneration starting pressure and the set pressure of the relief valve 65 is returned to the initial set position when the pressure detected by the pressure reducing valve 49 falls below the turning regeneration starting pressure.

The turning regeneration starting pressure is set equal to the initial set pressure of the relief valve 65, i.e. the set pressure of the relief valve 65 not increased by the pilot pressure.

A regeneration control of turning regeneration is described below.

The controller 90 outputs a valve opening command to the electromagnetic proportional pressure reducing valve 101 to supply the pilot fluid to a pilot chamber 48*a* of the switching valve 48 and outputs a command to increase the pressure of the relief valve 65 to the adjuster 60 when determining that the pressure detected by the pressure reducing valve 49 has reached the turning regeneration starting pressure. In this way, the switching valve 48 is switched to an open position to start the turning regeneration and the set pressure of the relief valve 65 increases from the initial set pressure.

As just described, since the set pressure of the relief valve 65 increases from the initial set pressure at the same time as the switching valve 48 is switched to the open position to start the turning regeneration, the hydraulic oil from the turning circuit 75 is difficult to flow to the relief valve 65 and is introduced to a regeneration motor 88 through the switching valve 48. Thus, a regeneration amount reduction is suppressed.

Conventionally, it has been necessary to set the turning regeneration starting pressure for opening the switching valve 48 at a pressure lower than the initial set pressure of the relief valve 65 in order to make the flow of the hydraulic oil from the turning circuit 75 to the relief valve 65 difficult during the turning regeneration in which the switching valve 48 is switched to the open position. That is, it has been necessary to set a valve opening timing of the switching valve 48 earlier than that of the relief valve 65 to suppress a regeneration amount reduction. Since a turning motor 76 performs a turning operation and a braking operation at a pressure lower than the initial set pressure of the relief valve 65 in that case, acceleration/deceleration performance of the turning motor 76 has been poor.

However, in the present embodiment, the pressure of the relief valve 65 is increased to make the flow of the hydraulic oil from the turning circuit 75 to the relief valve 65 difficult during the turning regeneration. Thus, the turning regeneration starting pressure for opening the switching valve 48 needs not be set at a pressure lower than the initial set pressure of the relief valve 65 and can be set equal to the initial set pressure of the relief valve 65. Accordingly, even during the turning regeneration, the turning motor 76 performs the turning operation and the braking operation at the set pressure of the relief valve 65, wherefore acceleration/deceleration performance of the turning motor 76 is not deteriorated.

As described above, in the present embodiment, it is possible to improve acceleration/deceleration performance of the turning motor 76 during the turning regeneration and suppress a regeneration amount reduction.

Here, it can be thought, as a method for improving acceleration/deceleration performance of the turning motor 76 during the turning regeneration and suppressing a regeneration amount reduction, to set the set pressure of the relief valve 65 higher than a normal set pressure in advance and set the turning regeneration starting pressure for opening the switching valve 48 lower than the set pressure of the relief valve 65.

However, in this method, the turning pressure during the turning operation of the turning motor 76 and the braking pressure during the braking operation of the turning motor 76 are increased when a trouble of an electrical device or the like occurs and the turning regeneration cannot be performed. Thus, acceleration/deceleration performance becomes excessive.

Contrary to this, in the present embodiment, an operation can be performed with normal acceleration/deceleration performance even in the event of such a situation since the turning motor 76 performs the turning operation and the braking operation at the initial set pressure of the relief valve 65 that is not increased. As just described, in the present embodiment, the construction machine can be operated with a normal feeling even if the turning regeneration cannot be performed.

The controller 90 stops a valve opening command to the switching valve 48 and a command to increase the pressure of the relief valve 65 to the adjuster 60 when determining that the pressure detected by the pressure sensor 49 has fallen below the turning regeneration starting pressure. In this way, the switching valve 48 is switched to the closed position to stop the turning regeneration and a pressure increase of the relief valve 65 by the adjuster 60 is canceled, whereby the set pressure of the relief valve 65 returns to the initial set pressure.

According to the above fourth embodiment, functions and effects similar to those of the first embodiment are exhibited. Further, when the switching valve 48 is opened to perform the turning regeneration, the set pressure of the relief valve 65 is increased from the initial set pressure. Thus, the hydraulic oil from the turning circuit 75 is difficult to flow to the relief valve 65 and introduced to the regeneration motor 88. Therefore, a regeneration amount reduction is suppressed. Further, the hydraulic oil from the turning circuit 75 is difficult to flow to the relief valve 65 when the turning regeneration is performed, with the result that the turning regeneration starting pressure for opening the switching valve 48 needs not be set at a pressure lower than the initial set pressure of the relief valve 65. Thus, even when the turning regeneration is performed, acceleration/deceleration performance of the turning motor 76 is not deteriorated. Therefore, it is possible to improve acceleration/deceleration performance of the turning motor 76 during the turning regeneration and suppress a regeneration amount reduction.

In the aforementioned fourth embodiment, the relief valve 65 is configured to be provided at the position branched off from the side upstream of the switching valve 48 for controlling the passage of the hydraulic oil introduced from the turning circuit 75. In this case, since it is sufficient to provide the single relief valve 65, cost can be reduced. Instead of this, the relief valves 28, 29 provided in the respective supply/discharge passages 26, 27 shown in FIGS. 1, 3 and 4 may be configured similarly to the relief valve 65. Even if such a configuration is adopted, functions and effects similar to those of the aforementioned fourth embodiment are exhibited.

Although an embodiment of the present invention has been described, the embodiment is merely one of application examples of the present invention and by no means limits the technical scope of the present invention to a specific configuration of the above-mentioned embodiment.

This application claims priority to Japanese Patent Application No. 2013-201408 filed in the Japanese Patent Office on Sep. 27, 2013, the entire contents of which are incorporated by reference herein.

The invention claimed is:

1. A control system for hybrid construction machine, comprising:

a fluid pressure pump which is a drive source of a turning motor;

a regeneration motor for regeneration configured to be rotated by working fluid introduced from a turning circuit for driving the turning motor;

a rotating electric machine which is coupled to the regeneration motor;

a pressure detector configured to detect a turning pressure during a turning operation of the turning motor or a braking pressure during a braking operation of the turning motor;

a controller configured to execute a regeneration control of the hybrid construction machine;

a switching valve for turning regeneration configured to be switched by a pressure of supplied pilot fluid and perform turning regeneration by introducing the working fluid from the turning circuit to the regeneration motor when being switched to an open position;

an electromagnetic proportional pressure reducing valve configured to be switched to an open position in response to a command from the controller and generate a pilot secondary pressure for switching the switching valve for turning regeneration to the open position when a pressure detected by the pressure detector reaches a first set pressure set in advance; and a pilot switching valve configured to be provided in series with the electromagnetic proportional pressure reducing valve and allow the passage of the pilot fluid for switching the switching valve for turning regeneration to the open position by being switched to an open position using a pressure of the turning circuit as a pilot pressure when the pressure of the turning circuit reaches a second set pressure set in advance.

2. The control system for hybrid construction machine according to claim 1, wherein:

the first set pressure is set at a turning regeneration starting pressure at which the turning regeneration is started; and the second set pressure is set lower than the first set pressure.

3. The control system for hybrid construction machine according to claim 1, wherein:

the pilot switching valve is arranged between the electromagnetic proportional pressure reducing valve and the switching valve for turning regeneration.

4. The control system for hybrid construction machine according to claim 1, wherein:

the switching valve for turning regeneration is switched by a pressure of the pilot fluid introduced from a pilot pump.

5. The control system for hybrid construction machine according to claim 1, wherein:

the switching valve for turning regeneration is switched by the pressure of the turning circuit for switching the pilot switching valve to the open position.

6. The control system for hybrid construction machine according to claim 1, further comprising:

a turning regeneration passage in which the switching valve for turning regeneration is provided;

a pressure reducing valve which is provided on a side downstream of the switching valve for turning regeneration in the turning regeneration passage;

a bypass passage which is connected to the turning regeneration passage and bypasses the pressure reducing valve; and a bypass valve which is provided in the bypass passage and has a shut-off position and a communication position.

7. The control system for hybrid construction machine according to claim 6, further comprising:

a fluid pressure cylinder configured to be driven by the fluid pressure pump;

an operating state detector configured to detect an operating state of the fluid pressure cylinder;

a switching valve for cylinder regeneration configured to be provided in parallel to the switching valve for turning regeneration, opened based on a detection result of the operating state detector and performs cylinder regeneration by introducing the working fluid from the fluid pressure cylinder to the regeneration motor;

a cylinder regeneration passage in which the switching valve for cylinder regeneration is provided; and a joint regeneration passage to which the turning regeneration passage and the cylinder regeneration passage are joined and connected and which introduces the working fluid to the regeneration motor.

8. The control system for hybrid construction machine according to claim 7, wherein:

the regeneration motor is rotated by the working fluid introduced from the turning circuit for driving the turning motor and the working fluid introduced from the fluid pressure cylinder; and the bypass valve is set to the communication position when only the turning regeneration is performed while being set to the shut-off position when the turning regeneration and the cylinder regeneration are simultaneously performed.

9. The control system for hybrid construction machine according to claim 8, wherein:

the regeneration motor is a variable displacement motor capable of adjusting a tilt angle of a swash plate; and the controller is configured to control the tilt angle of the swash plate and a rotating speed of the regeneration motor so that the pressure detected by the pressure detector does not fall below the first set pressure when only the turning regeneration is performed.

10. The control system for hybrid construction machine according to claim 7, wherein:

the switching valve for turning regeneration is set to a shut-off position when the pressure detected by the pressure detector is below the first set pressure, set to a first communication position for opening the bypass passage when the pressure detected by the pressure detector reaches the first set pressure and the switching valve for cylinder regeneration is closed, and set to a second communication position for opening the turning regeneration passage and shutting off the bypass passage when the pressure detected by the pressure detector reaches the first set pressure and the switching valve for cylinder regeneration is in a valve-opened state.

11. The control system for hybrid construction machine according to claim 7, wherein:

the switching valve for turning regeneration is set to a shut-off position when the pressure detected by the pressure detector is below the first set pressure, set to a first communication position for introducing the working fluid from the turning circuit to the regeneration motor without reducing the pressure of the working fluid when the pressure detected by the pressure detector reaches the first set pressure and the switching valve for cylinder regeneration is closed, and set to a second communication position for throttling and introducing the working fluid from the turning circuit to the regeneration motor when the pressure detected by the pressure detector reaches the first set pressure and the switching valve for cylinder regeneration is in a valve-opened state.

12. The control system for hybrid construction machine according to claim 1, further comprising:

a relief valve configured to allow the flow of the working fluid toward a low-pressure side by being opened when the turning pressure during the turning operation of the turning motor or the braking pressure during the braking operation of the turning motor reaches a set pressure; and an adjuster configured to adjust the set pressure of the relief valve;

wherein the adjuster is configured to increase the set pressure of the relief valve from an initial set pressure when a pressure detected by the pressure detector reaches the first set pressure.

* * * * *